United States Patent [19]

Fukase et al.

[11] 4,144,835

[45] Mar. 20, 1979

[54] CONTACT HEAT FIXING APPARATUS

[75] Inventors: Yasuji Fukase; Hiroo Nishide, both of Ebina, Japan

[73] Assignee: Rank Xerox Limited, London, England

[21] Appl. No.: 844,849

[22] Filed: Oct. 25, 1977

[30] Foreign Application Priority Data

Nov. 5, 1976 [JP] Japan ..... 51-148031[U]

[51] Int. Cl.[2] ..... H05B 1/02

[52] U.S. Cl. ..... 118/5; 118/60; 219/216; 219/469; 432/60

[58] Field of Search ..... 118/60, 5; 432/60, 228; 219/216, 471, 469, 493, 494

[56] References Cited

U.S. PATENT DOCUMENTS

| | | | |
|---|---|---|---|
| T947012 | 1/1976 | Brandon et al. | 432/228 |
| 3,946,199 | 3/1976 | Nakamura | 219/216 X |
| 4,001,545 | 1/1977 | Wada et al. | 219/216 |
| 4,006,985 | 2/1977 | Hutner | 219/216 X |
| 4,046,990 | 9/1977 | White | 219/471 |
| 4,078,166 | 3/1978 | Kitamura et al. | 219/216 |

*Primary Examiner*—Mervin Stein

[57] ABSTRACT

A contact heat fixing apparatus comprising heat roll 1 having metal core 3 coated with heat resistant toner releasing material 4 on the surface thereof and provided with a heating element to the inside thereof. Temperature control circuit A comprising detection circuit 15 for the detection of the surface temperature of heat roll 1, comparison circuit 16 for comparing the level of a signal issued from said detection circuit 15 with that of a reference signal, pulse generation circuit 17 for converting the signal produced from said comparison circuit 16 into a pulse and an alternating current power source 12 whose electric power to be supplied to said heating element 11 is controlled by the signal from said pulse generation circuit, and switching circuit B for applying, to said temperature control circuit A, control signals which control the surface temperature of said heat roll 1 to set temperature $T_1$ during a copy stand-by period, to set temperature $T_2$ lower than said set temperature $T_1$ during copy operation after a certain period from the start of copy, and again to set temperature $T_1$ after another certain period from the completion of copy operation.

9 Claims, 6 Drawing Figures

CONTACT HEAT FIXING APPARATUS

DETAILED DESCRIPTION OF THE INVENTION

This invention relates to a contact heat fixing apparatus for electrophotographic copying machines, more specifically, to a contact heat fixing apparatus with improved temperature control means for attaining uniform contact heat fixing.

Conventional electrophotographic copying machines have often employed a fixing apparatus of the so-called, heat roll type. Such an apparatus comprises rolls applied, on the surfaces thereof, with coating films or layers made of a substance, for example, tetrafluoroethylene resin, silicone rubber, fluorocarbon resin or the like which has a low affinity for toner. A heating element such as infrared ray lamp is provided to the inside of either or both of the rolls and both of the rolls are put under an adequate pressure and rotatably supported at the axes thereof. Fixing of the toner images is performed by passing copy sheets or the like carrying thereon thermoplastic powder (referred to hereinafter as toner) between both the rolls described above. Although the apparatus of the heat roll fixing type is advantageous in that it can be operated with a relatively low electric power and no fire hazards, temperatures, pressures, and feeding speeds for paper sheets or the like for both of the rolls have to be selected in limited relations. Deviation from the above relations tends to cause such problems as adhesion of toners to the heat roll, so-called offset, which cause failures in fixing or the like, which necessitates accurate temperature control in order to avoid such defects. With all such counter measures, uniform fixing performance is quite difficult to maintain since non-adherent substances, for example, silicone rubber, tetrafluoroethylene resin, fluorocarbon resin or the like applied as a coating on the surface of the heat roll of an internal heating type usually has a very low thermal conductivity which significantly delays the response in thermal conduction from the heating elements to the surface of the heat roll thereby resulting in remarkable fluctuations in the surface temperature.

Specifically, a conventional contact heat fixing apparatus comprises, as shown in FIG. 1, a heat roll 1 having a metal core 3 applied with non-adherent coating 4 on the surface and heating element 7 disposed in the inside thereof, and press roll 2 having metal shaft 5 applied therearound with heat resistant resilient body 6. These rolls are adapted so that both rolls 1 and 2 cooperate by a mechanism not shown to contact each other exerting a pressure to copy sheets 8 and toner images 9 during a fixing operation and to separate from each other during a copy stand-by period or the like.

Reference numeral 10 denotes an element for the detection of temperature of heat roll 1, from which thermal inputs to heating element 7 can be controlled so that the temperature of heat roll 1 may be kept constant by a control circuit not shown in FIG. 1. Each of rolls 1 and 2 may optionally have a cleaning device and a release agent feeding device respectively not shown in FIG. 1.

FIG. 2 shows a typical example of changes with time in the surface temperature of heat roll 1 and in the temperature at the adhesion interface between non-adherent coating 4 and metal core 3 of heat roll 1.

In FIG. 2, T represents temperature, $T_o$ a set temperature, t time, P starting point for copy process, Q completion point for copy process, $T_c$ temperature at the interface between a non-adherent coating and a metal core, and $T_d$ surface temperature of heat roll.

In FIG. 2, region A represents a copy stand-by period in which temperature is controlled to a constant level. Then, in region B, surface temperature rapidly falls with the start of copy operation till the passage of several copy sheets. This phenonemon occurs because thermal conduction from heat roll 1 to copy sheets 8 and press roll 2 at relatively lower temperatures takes place only with the heat present on the surface layer of non-adherent coating 4 since the thermal conductivity of the non-adherent coating is extremely low. While the fall in the surface temperature is detected by temperature detection element 10 disposed in contact with or near the heat roll 1 and immediate heat for raising the temperature of heat roll 1 is effected, recovery in the surface temperature is delayed and the amount of heat and temperature reduction is increased since it takes more time for thermal conduction as the thickness of non-adherent coating 4 increases.

Region C represents a recovery period in which temperature recovers to a predetermined set temperature with the difference between the surface temperature at the adhesion interface being kept constant.

Region D represents a state in which heat control to a predetermined set temperature is performed. Finally, in region E, where the copying process has been completed and copy sheets 8 are no longer fed, temperature gradient present so far in the inside of non-adherent coating 4 becomes less steep because the heat is no longer supplied, resulting in the phenomenon of rapid rise in the surface temperature to such an extent that the increment in the temperature is about one-half of the difference found just before the surface temperature of the roll and the temperature on the adhesion interface.

As discussed by the foregoing, surface temperature of heat roll 1 changes over a wide range falling and rising with the start and end of the copying operation respectively. Since the surface temperature of heat roll 1 is usually determined so that satisfactory fixing may be attained in copying first several copy sheets but under yet insufficient fixing conditions, amount of heat supplied to copy sheets 8 and toner images 7 increases as the copying process proceeds in copying a number of sheets. This sometimes leads to an offset phenomenon due to excess amount of heat and results in consumption of unnecessary amount of heat. Moreover, temperature rise at the adhesion interface results in sooner adhesion degradation there.

BRIEF SUMMARY OF THE INVENTION

This invention has been made in view of the foregoing and it is an object of the invention to perform temperature control for the heating roll separately during a copy stand-by period and a subsequent period from the start of copy up to a certain time and during a copy operation period and a subsequent period from the completion of copy up to a certain time while setting the control temperature during the former stage higher than that during the latter stage, thereby maintaining stabilized fixing performance as well as greatly extending the service life of non-adherent coating of the heat roll.

DETAILED DESCRIPTION OF THE PREFERRED EMBODIMENT

Figure 3:
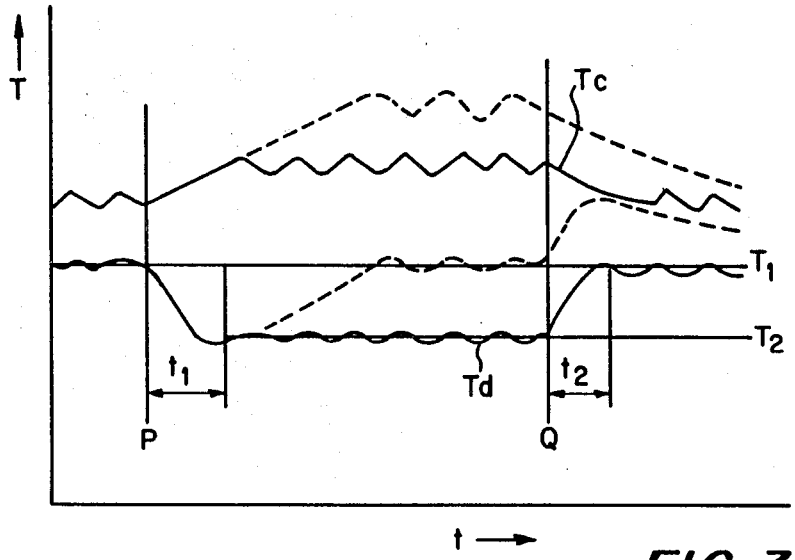
FIG. 3 is a chart for illustrating changes with time in the surface temperature of the heat roll and in the temperature at the interface between the non-adherent coating and the metal core of a heat roll in the heat contact fixing apparatus according to this invention.

This invention will now be described referring to FIG. 3 through FIG. 6. FIG. 3 shows an example of changes in the surface temperature $T_d$ of heat roll 1, and in the adhesion interface temperature $T_c$ between non-adherent coating 4 and metal core 3 of heat roll 1 in this invention. Dotted lines show temperature changes in conventional apparatus.

As shown in FIG. 3, it is intended to settle the surface temperature by lowering the control temperature for heat roll 1 stepwise as set temperature $T_1$ during a copy stand-by period and succeeding period $t_1$ from the start of copy up to a certain time, and as set temperature $T_2$ during a copy operation period and a succeeding period $t_2$ from the completion of copy up to a certain time. Since the fall in temperature resulting after the start of copy is due to thermal behavior of non-adherent coating 4, such a temperature fall always occurs although it varies in its degree depending on the amounts of heat supplied from heating element 7, performance of temperature control system, thermal physical values and thickness of coating layer 4. Therefore, if the second set temperature $T_2$ is put near to the lowest temperature to be attained under respective conditions, the surface temperature can be settled very rapidly to temperature $T_2$ thus set and, thereafter, controlled to such set temperature $T_2$ to thereby provide highly stabilized fixing performance. Moreover, since the temperature at the adhesion interface is also settled at a level corresponding to the lower surface temperature, the interface temperature can naturally be decreased as well thereby enabling extended service life of the non-adherent coating.

A more characteristic feature is that by maintaining the lower control temperature till the end of period $t_2$ subsequent to the completion of copy operation, the surface temperature rises by about one half of the difference between the surface temperature and the temperature at the adhesion interface found just before the completion of the copy operation. This phenomenon always appears and can be described by the fact that paper sheets have been put under heating so far and rapid settling to set temperature $T_1$ for the copy stand-by period can be attained by turning the set temperature back to initial temperature $T_2$ after the rising point of temperature.

As described above, fixing performance always stabilized throughout the copy process can be obtained and extension of service life of non-adherent coating 4 is enabled by reducing stepwise the set temperature for the heat roll while positively utilizing the low temperature response of non-adherent coating 4 which has heretofore been considered undesirable.

For further clarifying the features of this invention, preferred embodiments thereof are to be described.

Figure 1:
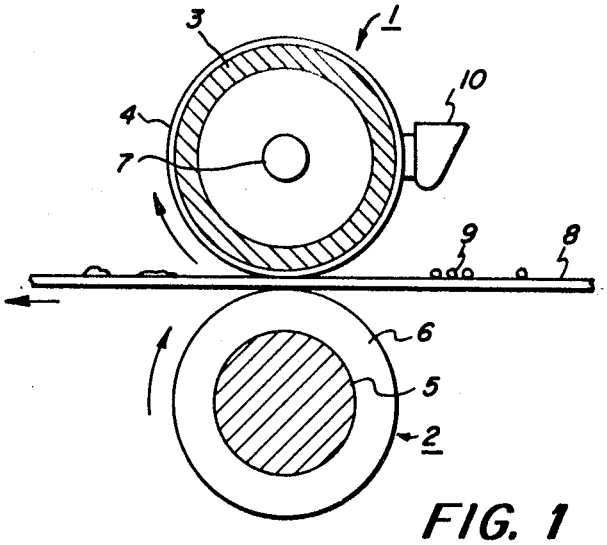
FIG. 1 (PRIOR ART)
FIG. 1 is a longitudinal sectional view of a conventional contact heat fixing apparatus.
Figure 2:
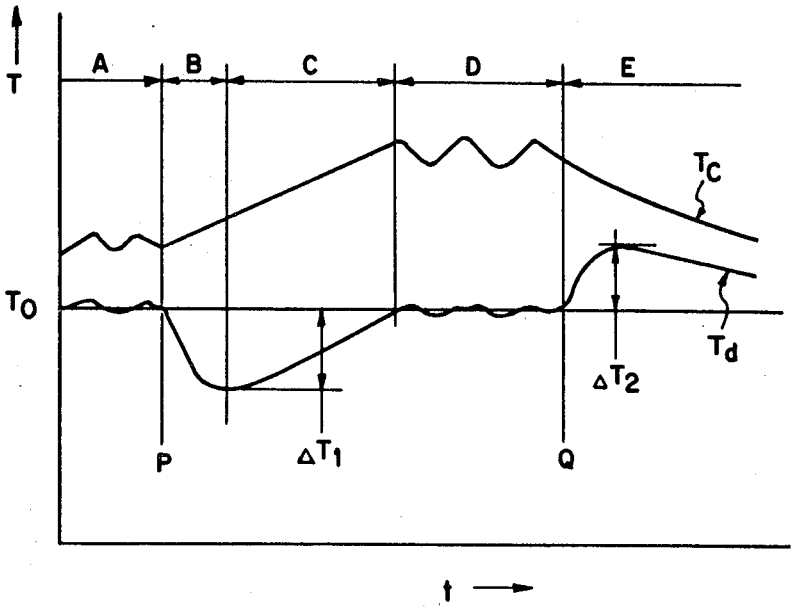
FIG. 2 (PRIOR ART)
FIG. 2 is a chart for illustrating changes with time in the surface temperature of the heat roll and in the temperature at the interface between the non-adherent coating and the metal core of a heat roll in a conventional apparatus.

A roll comprising steel core 3 having non-adherent silicone rubber coated in 600 $\mu$ thickness on the surface thereof and 1200 W heating element 7 in the inside thereof was employed as a heat roll 1 and set temperature $T_1$ was predetermined as 165° C. Press roll 2 comprised steel core 5 applied with a similar silicone rubber coating on the surface thereof. Both rolls 1 and 2 were of 50 mm in diameter. Copy sheets 8 were fed between rolls 1 and 2 at a rate of 2000 mm/sec and 2000 sheets/hour. In the conventional apparatus, as shown in FIG. 2, decrease in temperature $\Delta T_1$ after the start of copy operation reached 13° C., recovery to set temperature $T_1$ or $T_2$ was attained only after the passage of about 35 sheets of copy paper and the rise in temperature after the end of copy operation was 15° C. The temperature on the adhesion interface reached 192° C. at the maximum.

On the other hand, according to this invention, wherein first set temperature $T_1$ and second set temperature $T_2$ were set at 165° C. and 153° C. respectively and period $t_1$ from the start of copy to the time of switching to second set temperature $T_2$ and period $t_2$ from the end of copy to the time of switching to first set temperature $T_1$ were set as eight seconds respectively, the surface temperature was always kept at about 153° C. during copy operation and the copy products can be obtained with uniform fixing. The time required for settling to first set temperature $T_1$ after the completion of copy was only about fifteen seconds which was about one-fifth of that required in the conventional process. Also, the temperature at the adhesion interface was reduced to 178° C., at the maximum, enabling to extend more than twice the service life of the non-adherent coating. The inverter has also found in various experiments that 5 to 30 seconds were effective for period $t_1$, that is after the start of copy up to the switching time to the second set temperature, within the practical ranges of types and thickness of the non-adherent coating and voltages to be applied. Periods of 5 to 30 seconds of time were found also sufficiently effective for period $t_2$, from the completion of copy up to the switching time to the first set temperature. Within the above described time range, however, the difference between first and second set temperatures $T_1$ and $T_2$ exceeding 30° C. was near to the limit of unsatisfactory fixing and not acceptable when taking other factors into consideration.

The maximum values for them can be determined by experimental procedures or the like depending on the conditions employed.

Figure 4:
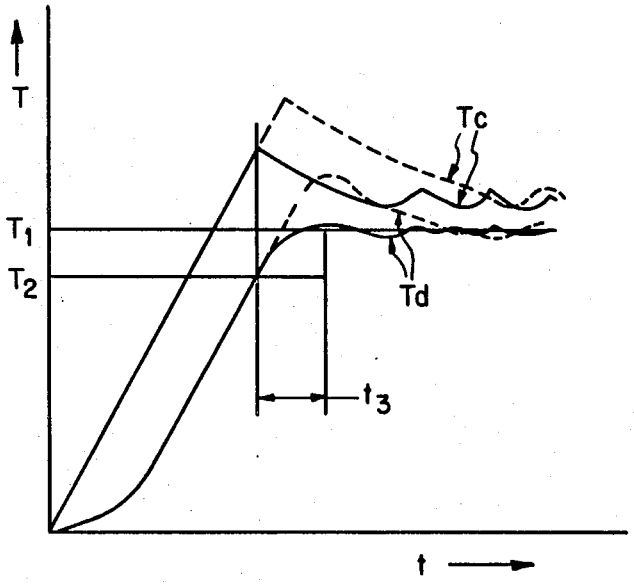
FIG. 4 is a chart for illustrating the changes with time of over-shoot quantity in temperature rise of the heat roll.

Moreover, in raising the temperature of heat roll 1 to first set temperature $T_1$ utilizing the two levels of set temperatures above described, if heating is started at second temperature $T_2$ at first and the temperature control is then switched to first set temperature $T_1$ after certain period $t_3$ subsequent to the arrival of the surface temperature of heat roll 1 to first set temperature, settling to first set temperature $T_1$ can be attained very rapidly and unnecessary rise in the temperature at the adhesion interface between non-adherent coating 4 and metal core 3 can be obviated, as shown in FIG. 4, whereby stabilization of fixing performance and avoidance in the degradation of adhesion interface can also be achieved. Periods of 5 to 30 seconds were again found effective for period $t_3$.

As can be seen from the foregoing, stepwise changes in set temperatures for heat roll 1 provide various advantages and reference will now be made to a preferred embodiment of a contact heat fixing apparatus for practicing such according to this invention.

Figure 5:
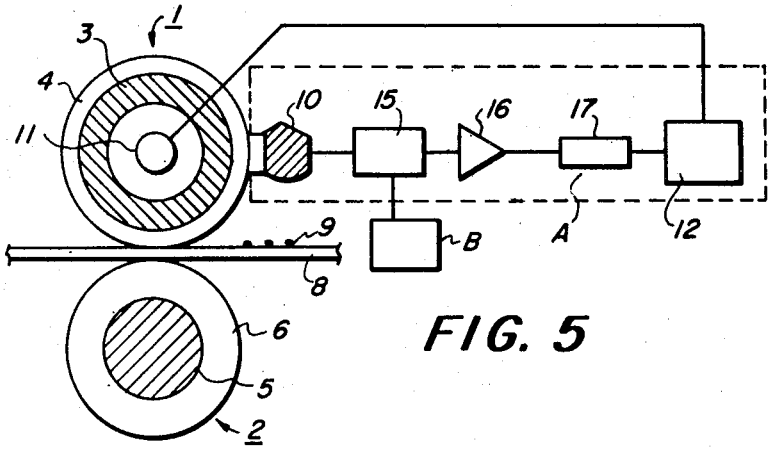
FIG. 5 is an explanatory view for the construction of an embodiment of this invention.

In FIG. 5, reference numeral 1 denotes a heat roll comprising metal core 3 having non-adherent coating 4 applied on the surface thereof and a heater 11 as a heating element in the inside thereof, and reference numeral 2 denotes a press roll comprising metal shaft 5 having heat resistant resilient body therearound. Both of rolls 1 and 2 cooperate with a mechanism not shown to contact each other while exerting pressures to copy sheets 8 and toner images 9 during fixing operation and to separate from each other during a copy standby period or the like. Reference 10 denotes an element for detecting the temperature of heat roll 1 and embodied herein as a negative characteristic thermistor for the detection of the temperature on the surface of the heat roll. There are also shown AC power source 12 for energizing heater 11, bilateral thyristor 13, DC power source 14 for the operation of control circuit, bridged detection circuit 15, comparator (comparison circuit) 16, and trigger pulse generation circuit 17.

Figure 6:
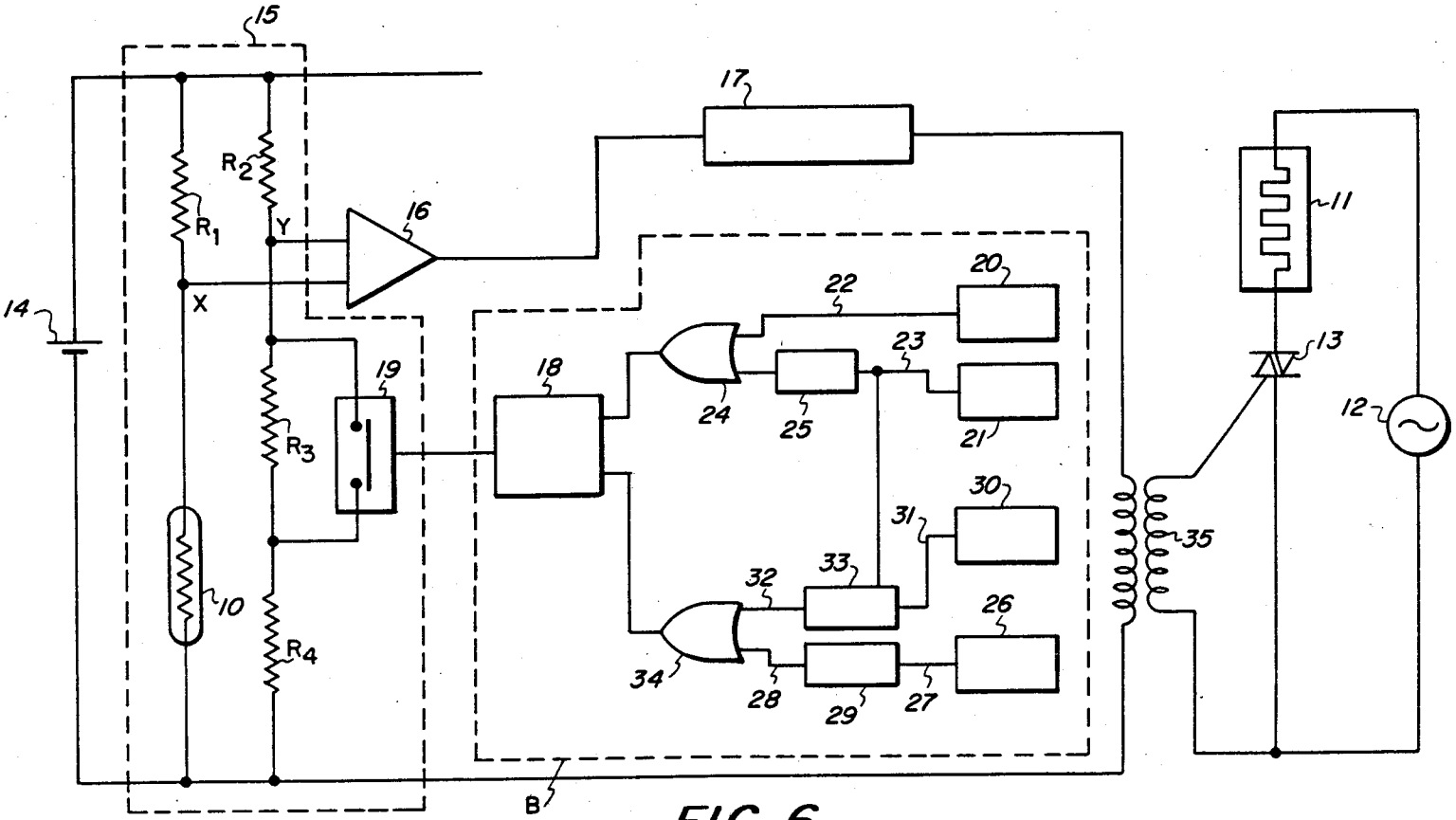
FIG. 6 is a control circuit diagram for use with a heat contact fixing apparatus according to this invention.

Detection circuit 15 as illustrated in FIG. 6 comprises thermistor 10 having negative resistance characteristics is provided which together with resistors $R_1$, $R_2$, $R_3$, and $R_4$ serve to detect the surface temperature of the heat roll and provide a potential at X indicative thereof. A variable reference potential is also provided at Y. A temperature control circuit A is composed of heating element 11, AC power source 12 for energizing the heating element 11, bilateral thyristor 13, detection circuit 15, comparison circuit 16 and trigger pulse generation circuit 17.

Switching circuit B is composed of flip-flop 18, OR circuits 24, 34, timers 25, 33, 29, power switch button 20, copy start switch button 21, print run completion circuit 30, and "copy enable" signal circuit 26.

Therefore, when a potential at point X is higher than that at point Y in FIG. 6, that is, when the surface temperature of heat roll 1 is lower than the set temperature, output from comparator 16 turns to a Hi-level to generate a triggering pulse at the output of trigger pulse generation circuit 17 for exciting bilateral thryistor 13. The triggering pulse produced excites by way of pulse transformer 35 bilateral thyristor 13 to effect heating of heater 11. On the contrary, when the potential at point X is lower than that at point Y, outputs from comparator 16 turns to Low-level whereby no triggering pulse is generated at the output of trigger pulse generation circuit 17 and thus heater 11 is not energized.

Both ends of resistor $R_3$ are connected to switching element 19 which is short-circuited when flip-flop 18 takes a Low-output level.

The switch 19 is open when either the power switch button 20 for the machine or the copy start button 21 is depressed whereby a signal at a Hi-level appears on line 22 or 23. This causes OR circuit 24 to take a Hi-output level which, in turn, sets flip-flop 18 to produce a Hi-output level. Switching element 19 is thereby rendered open to raise the potential at point Y. Heat roll 1 is thus controlled to operate at a lower working temperature. Timer 25, disposed between copy start button 21 and OR circuit 24, is adapted to set OR circuit 24 to take a Hi-output level after period $t_1$, that is, from the start of copy till the switching to second set temperature $T_2$.

Signal at a Hi-level appears on line 27 at the operation of "copy enabled" signal circuit 26 which indicates the rise of the heat roll temperature to a level enabling copy operation, and a signal at a Hi-level appears on line 28 delayed by predetermined period $t_3$ through the timer action of timer 29. It is also adapted that a signal at a Hi-level appears on line 31 at the operation of circuit 30 which indicates the completion of copy for predetermined number of copy sheets and a signal at a Hi-level apparatus on line 32 delayed by predetermined period $t_2$ through the timer action of timer 33. Lines 28 and 32 are connected to OR circuit 34, which produces a Hi-level signal at its output to reset flip-flop 18 thereby causing switching element 19 to close except when both the lines 28 and 32 take a Low-level. This has the effect of providing a higher potential at Y than with the switch 19 open. Output line 23 from copy start button 21 is connected to timer 33 so as to reset it and avoid undesirable results caused when copy start button 21 is erroneously depressed again during operation of timer 33 after the completion of copy.

With such a circuit construction as above, intended control operation is attainable.

While in the above embodiment, a thermistor is used as means for temperature detection, it is of course possible and obvious to those skilled in the art to constitute the circuit using a thermocouple as temperature detection means, which apparently falls within the scope of this invention.

Further, although the descriptions have been made to the embodiment in which second set temperature $T_2$ is set constant, it may alternatively be adapted, for attaining more stabilized performance, that second set temperature for heat roll 1 is determined by detecting the temperature for press roll 2 and satisfying a specified relation between the temperatures for both rolls 1 and 2 as disclosed in Japanese Patent Laid Open Publication 39554/1975.

According to this invention having been constructed as detailed above, wherein set temperature for heat roll 1 is divided into two steps, that is, first set temperature $T_1$ for a copy standby period and continuing for a period $t_1$ after the start of copy and a second set temperature $T_2$ ($T1 > T2$) for the period during copy operation and $t_2$ from the completion of copy stabilized fixing performance can be maintained and the service life of non-adherent coating 4 can significantly be extended.

What is claimed is:

1. Fuser apparatus for fixing toner images on substrate material, said apparatus comprising:

first and second roll members;

a heating element disposed internally in one of said members and a source of energy therefor;

means for controlling the surface temperature of said roll first during a standby mode followed by a fusing mode and then a standby mode again;

said control means for controlling said surface temperature during a standby mode controlling it at a first temperature level and during said fusing mode at a second temperature level which is lower than said first temperature level;

means for delaying control at said second temperature after termination of said standby mode and for delaying control at said first temperature after termination of said fusing mode.

2. Apparatus according to claim 1 wherein said predetermined delays are in the order of 5 to 30 seconds.

3. Apparatus according to claim 1 wherein said delays are each approximately 8 seconds.

4. Apparatus according to claim 1 wherein said means for controlling the surface temperature of said one of said roll members comprises:

means for generating a signal proportional to the temperature of said surface;

means for generating a reference temperature signal;

means for comparing said signals and generating an output signal when said surface temperature sensed is below the predetermined temperature; and means for varying said means for generating said reference temperature signal to thereby provide for said first and second temperature levels.

5. Apparatus according to claim 4 wherein said means for varying said means for generating reference signal comprises means including a plurality of resistors and switch means operative to vary the number of resistors that are functional at any one time.

6. Apparatus according to claim 5 wherein said means for varying said means for generating a reference signal further comprises means for actuating said switch means in accordance with the mode of operation of said one of said roll members.

7. Apparatus according to claim 5 wherein said means for varying said means for generating a reference signal further comprises a flip-flop device operatively connecting said switch means to a plurality of additional switches.

8. Apparatus according to claim 7 wherein said additional switches comprise a power on switch, a copy start switch, a copy enable switch, and a run completion switch.

9. Apparatus according to claim 8 wherein all of said additional switches except said power on switch are provided with a timer to provide said delays when their associated switches are actuated.

* * * * *